US011913476B2

(12) United States Patent
Shibata et al.

(10) Patent No.: US 11,913,476 B2
(45) Date of Patent: Feb. 27, 2024

(54) COMPRESSOR SYSTEM

(71) Applicant: Mitsubishi Power, Ltd., Kanagawa (JP)

(72) Inventors: Takanori Shibata, Tokyo (JP); Akihiko Saito, Tokyo (JP); Keisuke Yamamoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 288 days.

(21) Appl. No.: 17/438,621

(22) PCT Filed: Mar. 24, 2020

(86) PCT No.: PCT/JP2020/012977
§ 371 (c)(1),
(2) Date: Sep. 13, 2021

(87) PCT Pub. No.: WO2020/196504
PCT Pub. Date: Oct. 1, 2020

(65) Prior Publication Data

US 2022/0220978 A1 Jul. 14, 2022

(30) Foreign Application Priority Data

Mar. 26, 2019 (JP) ..... 2019-059225

(51) Int. Cl.
*F04D 27/00* (2006.01)
*F04D 27/02* (2006.01)
(Continued)

(52) U.S. Cl.
CPC ..... *F04D 29/661* (2013.01); *F04D 27/001* (2013.01); *F04D 27/0223* (2013.01);
(Continued)

(58) Field of Classification Search
CPC .. F04D 29/661; F04D 27/001; F04D 27/0223; F04D 27/0246; F04D 27/0269; F04D 29/266; F04D 29/403
See application file for complete search history.

(56) References Cited

U.S. PATENT DOCUMENTS

2003/0161715 A1* 8/2003 McKee ..... F04D 27/001 415/118
2004/0068387 A1 4/2004 Bonanni et al.
(Continued)

FOREIGN PATENT DOCUMENTS

CN 101725466 6/2010
CN 102998479 3/2013
(Continued)

OTHER PUBLICATIONS

International Search Report dated May 26, 2020 in corresponding International Application No. PCT/JP2020/012977, with English translation.
(Continued)

*Primary Examiner* — Courtney D Heinle
*Assistant Examiner* — Andrew J Marien
(74) *Attorney, Agent, or Firm* — Wenderoth, Lind & Ponack, L.L.P.

(57) ABSTRACT

A compressor system includes: a compressor having an upstream region into which a working fluid flows, a downstream region in which the pressure of the working fluid is greater than that in the upstream region, inlet guide vanes that are provided further upstream than the upstream region and capable of altering the flow rate of the inflowing working fluid, and an extraction part that is provided to a portion between the upstream region and the downstream region and capable of extracting at least a portion of the working fluid; detection devices, at least one of which is provided in each of the upstream region and the downstream
(Continued)

region, for detecting the physical quantity of the working fluid; and a control device for adjusting, on the basis of changes in the physical quantity, the opening degree of the inlet guide vanes and the amount extracted by the extraction part.

18 Claims, 9 Drawing Sheets

(51) Int. Cl.
*F04D 29/66* (2006.01)
*F04D 29/26* (2006.01)
*F04D 29/40* (2006.01)

(52) U.S. Cl.
CPC ..... *F04D 27/0246* (2013.01); *F04D 27/0269* (2013.01); *F04D 29/266* (2013.01); *F04D 29/403* (2013.01)

(56) References Cited

U.S. PATENT DOCUMENTS

| | | | | |
|---|---|---|---|---|
| 2007/0031238 | A1* | 2/2007 | Fujii | F04D 27/0246 415/48 |
| 2008/0279676 | A1 | 11/2008 | Dejoris et al. | |
| 2010/0101328 | A1 | 4/2010 | Enevoldsen et al. | |
| 2014/0314543 | A1* | 10/2014 | Park | F04D 27/0215 415/146 |
| 2015/0323360 | A1 | 11/2015 | Doi et al. | |
| 2016/0053766 | A1* | 2/2016 | Lee | F04D 27/0284 415/17 |
| 2016/0123341 | A1 | 5/2016 | Higashi | |
| 2018/0066662 | A1* | 3/2018 | Takahashi | F02C 3/06 |
| 2018/0163736 | A1* | 6/2018 | Picanco | F04D 27/0207 |
| 2018/0209341 | A1* | 7/2018 | Nakahara | F02C 9/00 |

FOREIGN PATENT DOCUMENTS

| | | |
|---|---|---|
| CN | 104395709 | 3/2015 |
| CN | 106829850 | 6/2017 |
| CN | 109001486 | 12/2018 |
| DE | 3827444 | 2/1990 |
| EP | 0 597 440 | 5/1994 |
| JP | 62-084697 | 5/1987 |
| JP | 06-147189 | 5/1994 |
| JP | 2001-141539 | 5/2001 |
| JP | 2002-61593 | 2/2002 |
| JP | 2003-148173 | 5/2003 |
| JP | 2007-040171 | 2/2007 |
| JP | 4030490 | 1/2008 |
| JP | 2008-281001 | 11/2008 |
| JP | 2010-48213 | 3/2010 |
| JP | 2010-163962 | 7/2010 |
| JP | 2011-111996 | 6/2011 |
| JP | 2011-209038 | 10/2011 |
| JP | 5142886 | 2/2013 |
| WO | 2014/208668 | 12/2014 |
| WO | 2017/051766 | 3/2017 |

OTHER PUBLICATIONS

Written Opinion dated May 26, 2020 in corresponding International Application No. PCT/JP2020/012977, with English Translation.

* cited by examiner

COMPRESSOR SYSTEM

TECHNICAL FIELD

The present invention relates to a compressor system.

Priority is claimed on Japanese Patent Application No. 2019-059225, filed Mar. 26, 2019, the content of which is incorporated herein by reference.

BACKGROUND ART

For example, it is known that, if an operation point is changed to increase a pressure ratio while keeping the number of revolutions constant in turbo compressors including axial compressors and centrifugal compressors, a phenomenon called turning stall or surging may occur in some cases. Particularly, surging is likely to lead to backflow of a working fluid inside a compressor and vibration of a rotor shaft in some cases. For this reason, there is an increasing demand for techniques which can prevent or minimize surging.

As an example of such a technique, the technique described in Patent Literature 1 is known. Patent Literature 1 discloses various detection devices including a static pressure sensor, a dynamic pressure sensor, and a flow velocity sensor and a technique for perceiving changes that are indications of surging through frequency-processing a detection value using such detection devices.

CITATION LIST

Patent Literature

[Patent Literature 1]
Japanese Patent No. 4030490

SUMMARY OF INVENTION

Technical Problem

However, in the device described in Patent Literature 1, detection values using each of the detection devices may be included in noise (a fluctuation component) unless surging has progressed to some extent in some cases. Thus, it may not be possible to accurately detect an indication of surging in some cases.

The present invention was made to solve the above problems, and an object of the present invention is to provide a compressor system capable of detecting the occurrence of surging with higher accuracy and minimizing surging.

Solution to Problem

A compressor system according to an aspect of the present invention includes: a compressor having: an upstream region into which a working fluid flows, a downstream region that communicates with the upstream region and in which a pressure of the working fluid is greater than that in the upstream region, inlet guide vanes that are provided further upstream than the upstream region and are capable of altering a flow rate of the working fluid flowing into the upstream region, and an extraction part that is provided to a portion between the upstream region and the downstream region and is capable of extracting at least a portion of the working fluid; detection devices, at least one of which is provided in each of the upstream region and the downstream region, for detecting a physical quantity of the working fluid; and a control device for adjusting, on the basis of changes in the physical quantity detected by the detection devices, any one of an opening degree of the inlet guide vanes and an amount extracted by the extraction part.

According to the above constitution, at least one of the detection devices is provided in the upstream region and the downstream region of the compressor. The detection device detects a physical quantity of the working fluid. The control device detects an abnormality occurring in the flow of the working fluid on the basis of the changes in the physical quantity. The control device adjusts either the opening degree of the inlet guide vane or the extraction amount. Thus, it is possible to eliminate an abnormality occurring in the flow of the working fluid.

In the compressor system, each of the detection devices may include: a pair of temperature detection units that are arranged in a flow direction of the working fluid; and a heating unit that is disposed between the pair of temperature detection units and heats the working fluid, wherein the physical quantities may include a flow direction and a flow velocity of the working fluid based on a temperature difference of the working fluid detected by the pair of temperature detection units.

According to the above constitution, the detection device has the pair of temperature detection units arranged in the flow direction and the heating unit provided between them. When the working fluid passes through the pair of temperature detection units in the flow direction, the working fluid is heated by the heating unit. Thus, a difference occurs in a temperature which is detected between a temperature detection unit located on the downstream side in the flow direction and a temperature detection unit located on the upstream side. Therefore, it is possible to detect that the working fluid is flowing to a side on which the temperature detection unit having a higher detected temperature is located. That is to say, it is possible to detect the flow direction of the working fluid. In addition, when an absolute value of the temperature difference detected by the pair of temperature detection units is detected, it is also possible to detect changes in the flow velocity of the working fluid. Thus, for example, when backflow (that is, a change in the flow direction) occurs in the flow of the working fluid inside the compressor or a decrease in the flow velocity that is an indication of backflow occurs, it is possible to immediately detect the backflow and the decrease in the flow velocity.

In the above compressor system, the temperature detection unit and the heating unit may be directed exposed to the working fluid.

According to the above constitution, it is possible to immediately detect changes in the physical quantity of the working fluid. Thus, this makes it possible to improve the responsiveness of the entire device.

In the above compressor system, the control device may adjust the opening degree of the inlet guide vanes so that the opening degree increases when the temperature difference changes so that the temperature difference decreases in the downstream region.

According to the above constitution, when the temperature difference between the pair of temperature detection units detected by the detection devices in the downstream region decreases, it can be determined that the flow velocity of the working fluid has decreased in the downstream region. When the flow velocity continues to decrease, this is eventually likely to lead to a change in the flow direction. That is to say, it can be said that the decrease in flow velocity is an indication of backflow. In this case, it can be determined that the flow rate of the working fluid in the downstream region of the compressor becomes excessive and the flow of the working fluid begins to come to a standstill (surging is occurring). Thus, the control device adjusts the opening degree of the inlet guide vane so that the opening degree increases. Therefore, the flow rate of the working fluid supplied to the downstream region is reduced. As a result, surging can be prevented before the development thereof.

In the above compressor system, the control device may adjust the extraction amount so that the extraction amount increases when the temperature difference changes in the upstream region so that the temperature difference decreases.

According to the above constitution, when the temperature difference between the pair of temperature detection units detected by the detection devices in the upstream region decreases, it can be determined that the flow velocity of the working fluid has decreased in the upstream region. When the flow velocity continues to decrease, this is likely to eventually lead to a change in the flow direction. That is to say, it can be said that the decrease in the flow velocity is an indication of backflow. In this case, it can be determined that the flow rate of the working fluid in the upstream region of the compressor becomes excessive and the flow of the working fluid begins to come to a standstill (surging is occurring). Thus, the control device adjusts the extraction amount so that the extraction amount increases. Therefore, the working fluid that has come to a standstill in the upstream region is extracted and the standstill in the flow is eliminated. As a result, surging can be prevented before the development thereof.

In the above compressor system, the compressor may include: a rotor shaft that is capable of rotating around an axis line; a plurality of rotor blade stages that are provided on the rotor shaft and arranged in a direction of the axis line; a casing that covers the rotor shaft and the rotor blade stages from an outer circumferential side; and a plurality of stator blade stages that are provided on an inner circumferential surface of the casing and arranged alternately with the plurality of rotor blade stages in the direction of the axis line, wherein the upstream region being a region further upstream than a rotor blade stage of the plurality of rotor blade stages that is a third stage from the furthest upstream side, and wherein the downstream region being a region further downstream than a rotor blade stage of the plurality of rotor blade stages that is a third stage from the furthest downstream side.

Here, in the compressor as described above, it is known that surging particularly easily occurs in the region further upstream than the third rotor blade stage from the furthest upstream side and the region further downstream than the third rotor blade stage from the furthest downstream side. According to the above constitution, since the regions are the upstream region and the downstream region, it is possible to promptly and accurately detect the occurrence of surging and an indication thereof.

In the above compressor system, each of the stator blade stages may extend in a radial direction with respect to the axis line and include a plurality of stator blades arranged in a circumferential direction and having a suction surface facing upstream and a pressure surface facing downstream, and the detection device may be provided on the suction surface.

Here, the separation and the backflow of the working fluid are particularly easily generated on the suction surface of the stator blade. According to the above constitution, since the detection device is provided on the suction surface, it is possible to promptly and accurately detect the separation and the backflow described above.

In the above compressor system, the compressor may include: a rotor shaft that is capable of rotating around an axis line; an impeller that is provided on the rotor shaft; and a casing that covers the impeller from an outer circumferential side and forms a flow path through which the working fluid flows on an upstream side and a downstream side of the impeller, wherein the upstream region being a region in the flow path further upstream than the impeller, and wherein the downstream region being a region in the flow path further downstream than the impeller.

Here, it is known that, in the compressor as described above, surging particularly easily occurs in a region further upstream than the impeller and a region further downstream than the impeller. According to the above constitution, since the regions are the upstream region and the downstream region, it is possible to promptly and accurately detect the occurrence of surging and an indication thereof.

In the above compressor system, the flow path may have a diffuser flow path provided on a downstream side of the impeller and configured to guide the working fluid from an inner side to an outer side in the radial direction with respect to the axis line and a return flow path provided further downstream of the diffuser flow path and configured to guide the working fluid from the outer side to the inner side in the radial direction, and the detection device may be provided in at least one of the diffuser flow path and the return flow path.

According to the above constitution, since the detection device is provided in at least one of the diffuser flow path and the return flow path, it is possible to finely and accurately detect the occurrence of surging and an indication thereof in the downstream region.

A compressor system according to an aspect of the present invention includes: a compressor having: an upstream region into which a working fluid flows, a downstream region that communicates with the upstream region and in which a pressure of the working fluid is greater than that in the upstream region, inlet guide vanes that are provided further upstream than the upstream region and are capable of altering a flow rate of the working fluid flowing into the upstream region, and an extraction part that is provided to a portion between the upstream region and the downstream region and is capable of extracting at least a portion of the working fluid; detection devices, at least one of which is provided in each of the upstream region and the downstream region, for detecting a physical quantity of the working fluid; and a control device for adjusting, on the basis of changes in the physical quantity detected by the detection devices, an opening degree of the inlet guide vanes and an amount extracted by the extraction part, wherein the compressor includes: a rotor shaft that is capable of rotating around an axis line; a plurality of rotor blade stages that are provided on the rotor shaft and arranged in a direction of the axis line; a casing that covers the rotor shaft and the rotor blade stages from an outer circumferential side; and a plurality of stator blade stages that are provided on an inner circumferential surface of the casing and arranged alternately with the plurality of rotor blade stages in the direction of the axis line, wherein the upstream region is a region further upstream than a rotor blade stage of the plurality of rotor blade stages that is a third stage from the furthest upstream side, wherein the downstream region is a region further downstream than a rotor blade stage of the plurality of rotor blade stages that is a third stage from the furthest downstream side, wherein each of the stator blade stages extends in a radial direction with respect to the axis line and includes a plurality of stator blades arranged in a circumferential direction and having a suction surface facing upstream and a pressure surface facing downstream, and wherein each of the detection devices is provided on the suction surface.

At least one of the detection devices is provided in each of the upstream region and the downstream region of the compressor. The detection device detects a physical quantity of the working fluid. The control device detects an abnormality occurring in the flow of the working fluid on the basis of the changes in the physical quantity. The control device adjusts either the opening degree of the inlet guide vane or the extraction amount. Thus, it is possible to eliminate the abnormality occurring in the flow of the working fluid. In addition, it is known that, in the compressor as described above, surging particularly easily occurs in the region further upstream than the third rotor blade stage from the furthest upstream side and the region further downstream than the third rotor blade stage from the furthest downstream side. According to the above constitution, since the regions are the upstream region and the downstream region, it is possible to promptly and accurately detect the occurrence of surging and an indication thereof. Here, the separation and the backflow of the working fluid are particularly easily generated on the suction surface of the stator blade. According to the above constitution, since the detection device is provided on the suction surface, it is possible to promptly and accurately detect the separation and the backflow described above.

In the above compressor system, the detection device may include: a pair of temperature detection units that are arranged in a flow direction of the working fluid; and a heating unit that is disposed between the pair of temperature detection units and heats the working fluid, wherein the physical quantity may include a temperature difference of the working fluid detected by the pair of temperature detection units, and wherein the control device may determine a speed at which each of the inlet guide vanes is closed on the basis of a magnitude of the physical quantity when a command for reducing a load of the compressor is issued.

Here, when a command for reducing a load of the compressor is issued, if the inlet guide vane is closed at an excessively high speed to reduce the inflow of the working fluid, there is a risk of there being an insufficient amount of working fluid compressed in the downstream region and backflow of the working fluid to the upstream side (surging occurring). On the other hand, when the inlet guide vane is closed at an excessively low speed, the temperature of the combustion gas decreases due to an excessive supply of the working fluid to the combustor provided on the downstream side. As a result, there is a risk of generating combustion vibration and increasing an amount of NOx which is emitted. According to the above constitution, the control determines the speed at which the inlet guide vane is closed on the basis of the temperature difference detected by the pair of temperature detection units, that is, the speed or the flow rate of the fluid. For this reason, it is possible to close the inlet guide vane at an appropriate speed while preventing the surge and the unstable combustion described above. As a result, it is possible to stably and quickly reduce a load on the compressor.

In the above compressor system, the control device may close the inlet guide vane at a relatively high speed when the physical quantity is greater than a predetermined threshold value and close the inlet guide vane at a relatively low speed when the physical quantity is smaller than the threshold value.

According to the above constitution, it is possible to determine an optimum speed at which the inlet guide vane is closed simply by evaluating the magnitude of the physical quantity on the basis of the predetermined threshold value. Thus, it is possible to quickly reduce the load on the compressor while minimizing the likelihood of surges and unstable combustion occurring.

In the above compressor system, the control device may determine to which numerical range of a plurality of predetermined numerical ranges the physical quantity belongs and close the inlet guide vane by selecting a predetermined speed to correspond to the numerical range to which the physical quantity belongs.

According to the above constitution, it is possible to close the inlet guide vane by selecting the speed determined to correspond to the numerical range to which the physical quantity belongs. That is to say, it is possible to finely determine the speed at which the inlet guide vane will be closed on the basis of the magnitude of the physical quantity. As a result, it is possible to more quickly reduce the load on the compressor while further minimizing the likelihood of surges and unstable combustion occurring.

In the above compressor system, the control device may determine a speed at which the inlet guide vane is closed with reference to a table in which a relationship between the physical quantity and an optimum speed at which the inlet guide vane is closed according to a value concerning the physical quantity is shown.

According to the above constitution, it is possible to close the inlet guide vane by selecting the speed in accordance with the table in which the relationship between the optimum speed at which the inlet guide vane is closed and the physical quantity is shown. That is to say, it is possible to more finely determine the speed at which the inlet guide vane is closed on the basis of the magnitude of the physical quantity. Thus, it is possible to more quickly reduce the load on the compressor while further minimizing the likelihood of surges and unstable combustion occurring.

A compressor system according to an aspect of the present invention includes: a compressor having: an upstream region into which a working fluid flows, a downstream region that communicates with the upstream region and in which a pressure of the working fluid is greater than that in the upstream region, and inlet guide vanes that are provided further upstream than the upstream region and are capable of altering a flow rate of the working fluid flowing into the upstream region; detection devices, at least one of which is provided in the downstream region, for detecting a physical quantity of the working fluid; and a control device for adjusting, on the basis of changes in the physical quantity detected by the detection devices, an opening degree of the inlet guide vanes, wherein each of the detection devices includes a pair of temperature detection units that are arranged in a flow direction of the working fluid; and wherein a heating unit that is disposed between the pair of temperature detection units and heats the working fluid, wherein the physical quantity includes a temperature difference of the working fluid detected by the pair of temperature detection units, and wherein when a command for reducing a load of the compressor is issued, the control device determines a speed at which each of the inlet guide vanes is closed on the basis of a magnitude of the physical quantity.

Here, when a command for reducing a load on the compressor is issued, if the inlet guide vane is closed at an excessively high speed to reduce the inflow of the working fluid, there is a risk of there being an insufficient amount of working fluid compressed in the downstream region and backflow of the working fluid to the upstream side (surging occurring). On the other hand, when the inlet guide vane is closed at an excessively low speed, the temperature of the combustion gas decreases due to an excessive supply of the working fluid to the combustor provided on the downstream side. As a result, there is a risk of generating combustion vibration and increasing an amount of NOx which is emitted. According to the above constitution, the control device determines the speed at which the inlet guide vane is closed on the basis of the temperature difference detected by the pair of temperature detection units, that is, the speed or the flow rate of the fluid. For this reason, it is possible to close the inlet guide vane at an appropriate speed while preventing the surge and the unstable combustion described above. As a result, it is possible to stably and quickly reduce a load on the compressor.

In the above compressor system, the control device may close the inlet guide vane at a relatively high speed when the physical quantity is greater than a predetermined threshold value and close the inlet guide vane at a relatively low speed when the physical quantity is smaller than the threshold value.

According to the above constitution, it is possible to determine the optimum speed at which the inlet guide vane is closed simply by evaluating the magnitude of the physical quantity on the basis of the predetermined threshold value. Thus, it is possible to quickly reduce the load on the compressor while reducing the likelihood of surges and unstable combustion occurring.

In the above compressor system, the control device may determine to which numerical range of a plurality of predetermined numerical ranges the physical quantity belongs and close the inlet guide vane by selecting a predetermined speed to correspond to the numerical range to which the physical quantity belongs.

According to the above constitution, it is possible to close the inlet guide vane by selecting the speed determined to correspond to the numerical range to which the physical quantity belongs. That is to say, it is possible to more finely determine the speed at which the inlet guide vane is closed on the basis of the magnitude of the physical quantity. As a result, it is possible to more quickly reduce the load on the compressor while further reducing the likelihood of surges and unstable combustion occurring.

In the compressor system, the control device may determine a speed at which the inlet guide vane is closed with reference to a table in which a relationship between the physical quantity and an optimum speed at which the inlet guide vane is closed according to a value concerning the physical quantity is shown.

According to the above constitution, it is possible to close the inlet guide vane by selecting the speed in accordance with the table in which the relationship between the optimum speed at which the inlet guide vane is closed and the physical quantity is shown. That is to say, it is possible to more finely determine the speed at which the inlet guide vane is closed on the basis of the magnitude of the physical quantity. Thus, it is possible to more quickly reduce the load on the compressor while further reducing the likelihood of surges and unstable combustion occurring.

Advantageous Effects of Invention

According to the present invention, it is possible to provide a compressor system capable of detecting the occurrence of surging with higher accuracy and minimizing surging.

DESCRIPTION OF EMBODIMENTS

First Embodiment

Figure 1:
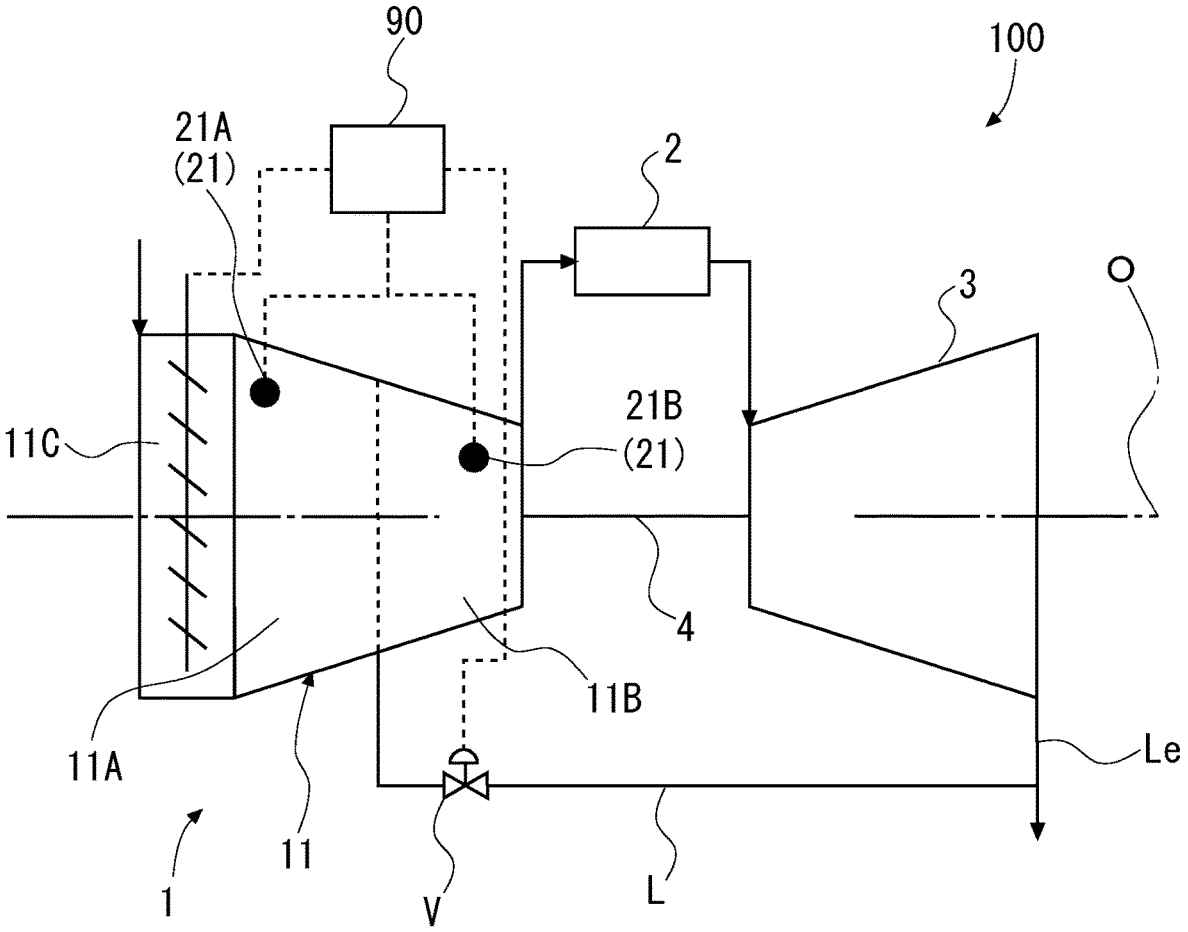
FIG. 1 is a diagram showing a constitution of a gas turbine according to a first embodiment of the present invention.

A first embodiment of the present invention will be described with reference to FIGS. 1 to 6. As shown in FIG. 1, a gas turbine 100 according to the embodiment includes a compressor system 1, a combustor 2, and a turbine 3. The compressor system 1 compresses external air (a working fluid) to generate high-pressure air. The combustor 2 mixes fuel with high-pressure air and burns the mixture to generate high-temperature and high-pressure combustion gas. The turbine 3 is rotationally driven using this combustion gas. The turbine 3 and the compressor system 1 are connected using a rotor shaft 4 extending along an axis line O. Therefore, the rotation of the turbine 3 is transmitted to the compressor system 1 via the rotor shaft 4.

The compressor system 1 includes a compressor 11, inlet guide vanes 11C, detection devices 21, a blow-off flow path L (an extraction part), a blow-off valve V, and a control device 90. The compressor 11 compresses air guided from one side (an upstream side) in a direction of an axis line O and supplies the compressed air to the combustor 2 provided on the other side (a downstream side). That is to say, the compressor 11 is an axial compressor. Although being described in detail later, the compressor 11 includes an upstream region 11A located on an upstream side in the direction of the axis line O and a downstream region 11B located on a downstream side. The pressure of the working fluid (air) in the downstream region 11B is greater than that in the upstream region 11A. External air is introduced into the upstream region 11A via the inlet guide vane 11C. The inlet guide vane 11C is provided to adjust an amount of air flowing through the upstream region 11A. Opening degree of the inlet guide vane 11C can be changed using an electrical signal transmitted from the control device 90 which will be described later.

In the upstream region 11A, at least one (a first detection device 21A) of the detection devices 21 which detect a physical quantity of air flowing through the upstream region 11A is provided. Similarly, in the downstream region 11B, at least one (a second detection device 21B) of the detection devices 21 which detect a physical quantity of air flowing through the downstream region 11B is provided.

Figure 2:
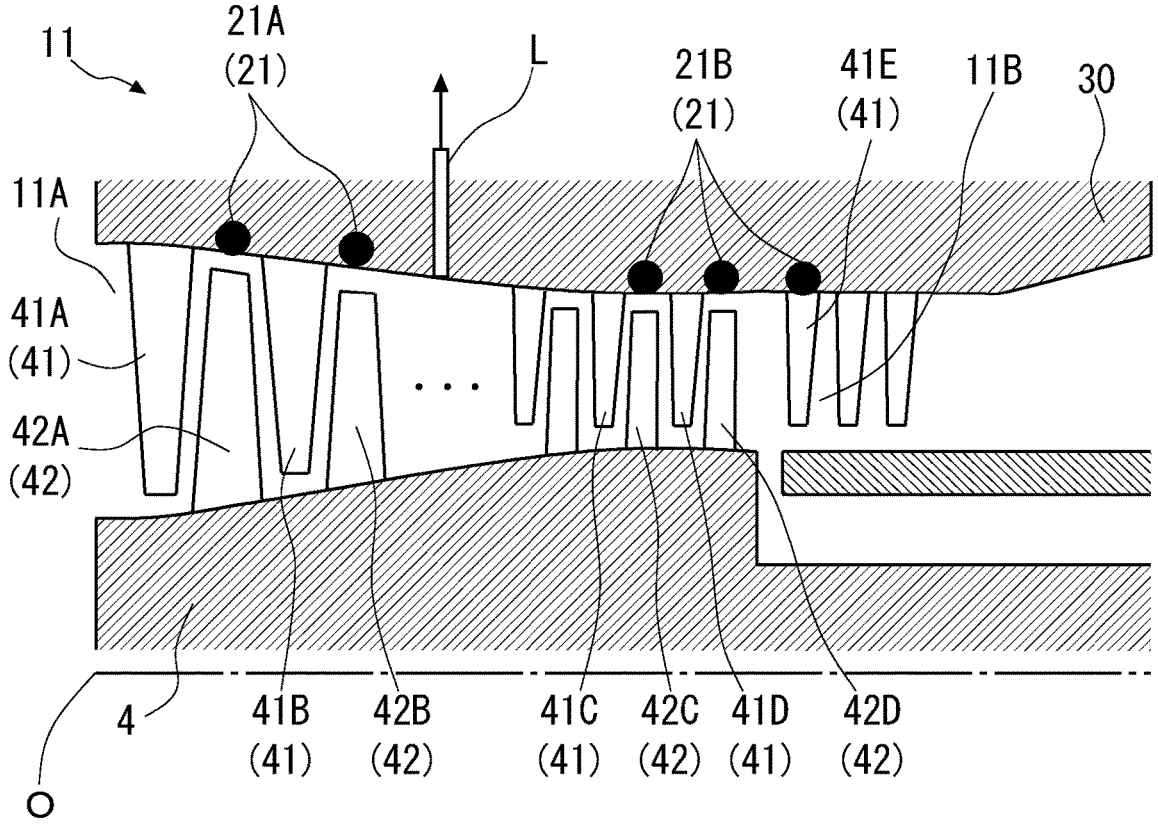
FIG. 2 is a cross-sectional view showing a constitution of a compressor system according to the first embodiment of the present invention.

Here, as shown in FIG. 2, the compressor 11 has the rotor shaft 4 which can rotate around the axis line O, a plurality of rotor blade stages 42 arranged on an outer circumferential surface of the rotor shaft 4 in the direction of the axis line O, a casing 30 which covers the rotor shaft 4 and the rotor blade stages 42 from an outer circumferential side, and a plurality of stator blade stages 41 provided on an inner circumferential surface of the casing 30. The stator blade stages 41 are arranged alternately with the rotor blade stages 42 in the direction of the axis line O. The upstream region 11A described above refers to a region further upstream than a rotor blade stage 42 of the plurality of rotor blade stages 42 that is a third stage from the furthest upstream side. That is to say, the first detection device 21A is provided on the inner circumferential surface of the casing 30 corresponding to a rotor blade stage 42 that is on the furthest upstream side (a first rotor blade stage 42A) and a rotor blade stage 42 that is a second stage from the upstream side (a second rotor blade stage 42B). It is also possible to provide the first detection device 21A for a first stator blade stage 41A adjacent to the first rotor blade stage 42A and a second stator blade stage 41B adjacent to the second rotor blade stage 42B.

Also, the downstream region 11B described above refers to a region further downstream than a rotor blade stage 42 of the plurality of rotor blade stages 42 that is a third stage from the furthest downstream side. That is to say, the second detection device 21B is provided on the inner circumferential surface of the casing 30 corresponding to a rotor blade stage 42 that is on the furthest downstream side (an outlet final rotor blade stage 42D) and a rotor blade stage 42 that is a second stage from the downstream side (an outlet rotor blade stage 42C). It is also possible to provide the second detection device 21B for an outlet final stator blade stage 41D adjacent to the outlet final rotor blade stage 42D and an outlet stator blade stage 41C adjacent to the outlet rotor blade stage 42C. Furthermore, it is also possible to provide the second detection device 21B on the inner circumferential surface of the casing 30 corresponding to a diffuser flow path stator blade stage 41E provided on a downstream side of the outlet final rotor blade stage 42D.

Figure 3:
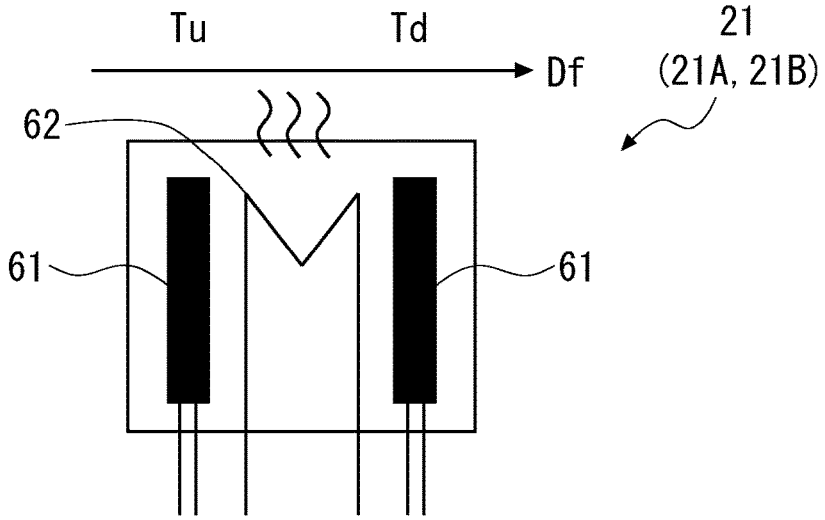
FIG. 3 is a schematic diagram showing a constitution of a detection device according to the first embodiment of the present invention.
Figure 6:
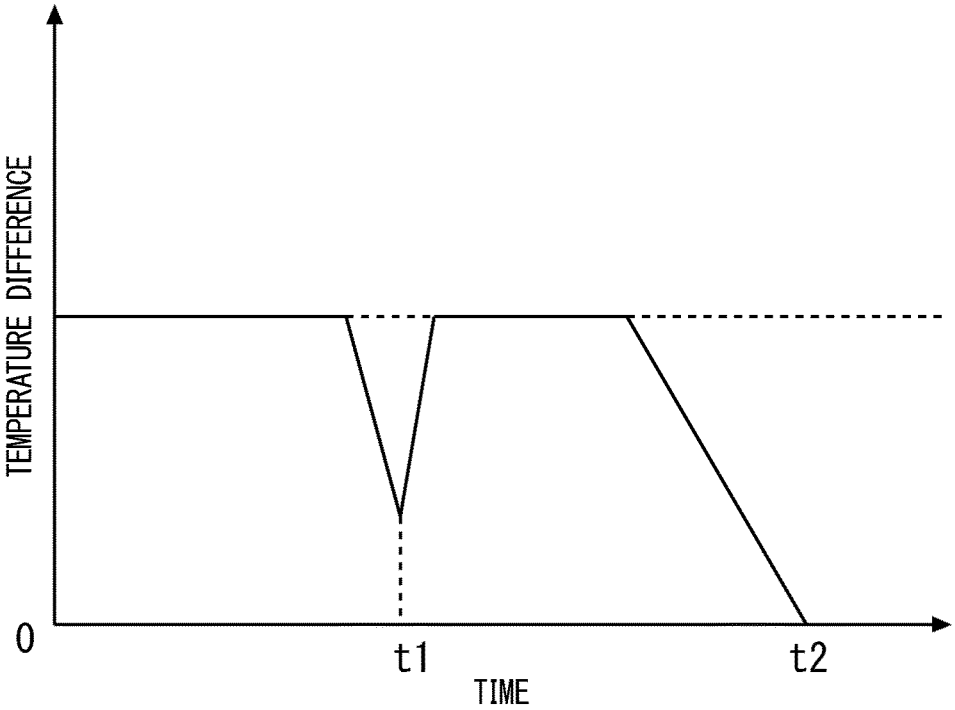
FIG. 6 is a graph for describing an example of changes in temperature difference detected using the detection device according to the first embodiment of the present invention.

The detection device 21 detects, as physical quantities, changes in flow direction Df and flow velocity of air in the compressor 11. As shown in FIG. 3, the detection device 21 has a pair of temperature detection units 61 arranged at intervals in the flow direction Df and a heating unit 62 provided between the temperature detection units 61. Both of the temperature detection units 61 and the heating unit 62 are directly exposed to the working fluid. That is to say, the temperature detection units 61 and the heating unit 62 are exposed in a surface (an inner circumferential surface) of the casing 30. Each of the temperature detection units 61 detects a temperature of air in contact with the temperature detection unit 61 itself. The heating unit 62 heats air flowing in the vicinity of the heating unit 62 itself. Since the air is heated by means of the heating unit 62, a temperature Td of air detected by the temperature detection unit 61 located on the downstream side in the flow direction Df is higher than a temperature Tu of the air detected by the temperature detection unit 61 located on the upstream side. Furthermore, a value of a temperature difference (Td−Tu) of these values increases as a flow velocity of the air increases. In addition, when the flow direction Df of the air changes (that is, the flow direction is reversed), the temperature difference (Td−Tu) has a negative value. FIG. 6 is a graph for describing an example of a change over time in this temperature difference. In the example in FIG. 6, a temperature difference is temporarily reduced at time t1. In this case, it can be determined that a flow velocity of air in a corresponding region has temporarily decreased. Furthermore, at time t2, the temperature difference is zero. In this case, it can be determined that a flow velocity of air in a corresponding region is zero (that is, a fluid comes to a standstill).

As shown in FIG. 1 or 2 again, the compressor 11 according to the embodiment includes the blow-off flow path L capable of extracting a portion of air flowing through a region (an intermediate stage) between the upstream region 11A and the downstream region 11B and the blow-off valve V provided on the blow-off flow path L. The blow-off flow path L is connected to an exhaust flow path Le communicating with an exhaust port of the turbine 3. When an opening degree of the blow-off valve V is adjusted, it is possible to change an amount of air extracted through the blow-off flow path L (an extraction amount).

Figure 4:
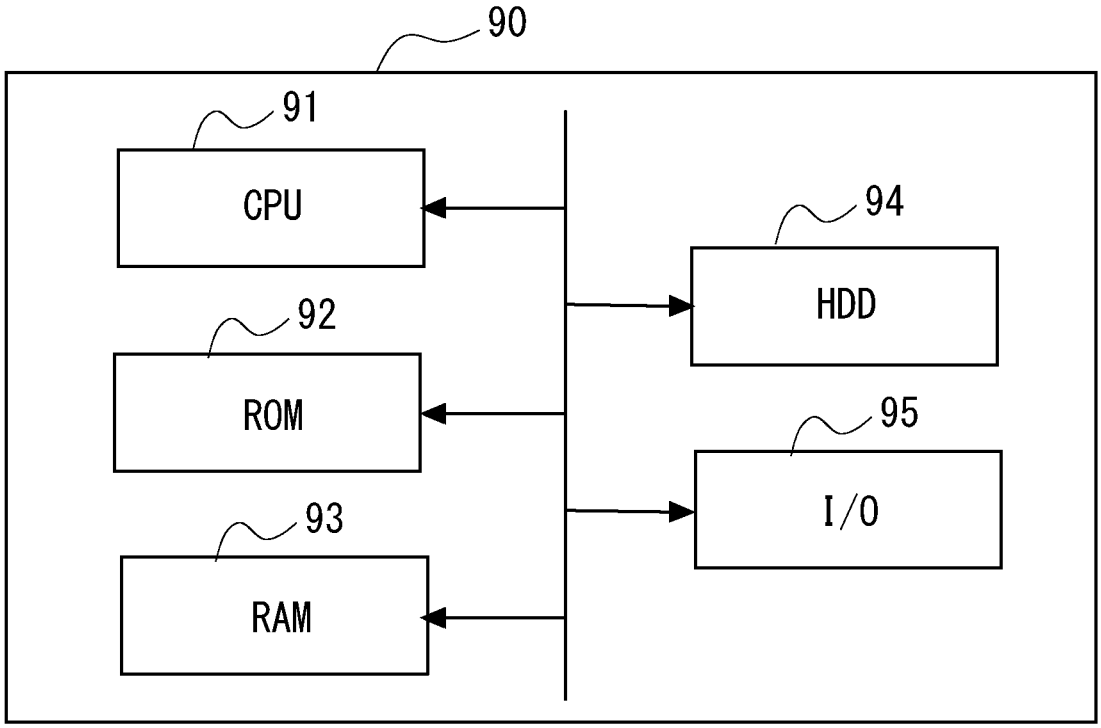
FIG. 4 is a diagram showing a constitution of hardware of a control device according to the first embodiment of the present invention.

The control device 90 adjusts an opening degree of the inlet guide vane 11C and an opening degree of the blow-off valve V on the basis of the physical quantity detected by the detection device 21 described above. As shown in FIG. 4, the control device 90 is a computer which includes a central processing unit (CPU) 91, a read only memory (ROM) 92, a random access memory (RAM) 93, a hard disk drive (HDD) 94, and a signal receiving module 95 (input/output: I/O). The signal receiving module 95 receives the physical quantity detected by the detection device 21 as an electric signal. The signal receiving module 95 may receive a signal amplified via, for example, a charge amplifier or the like.

Figure 5:
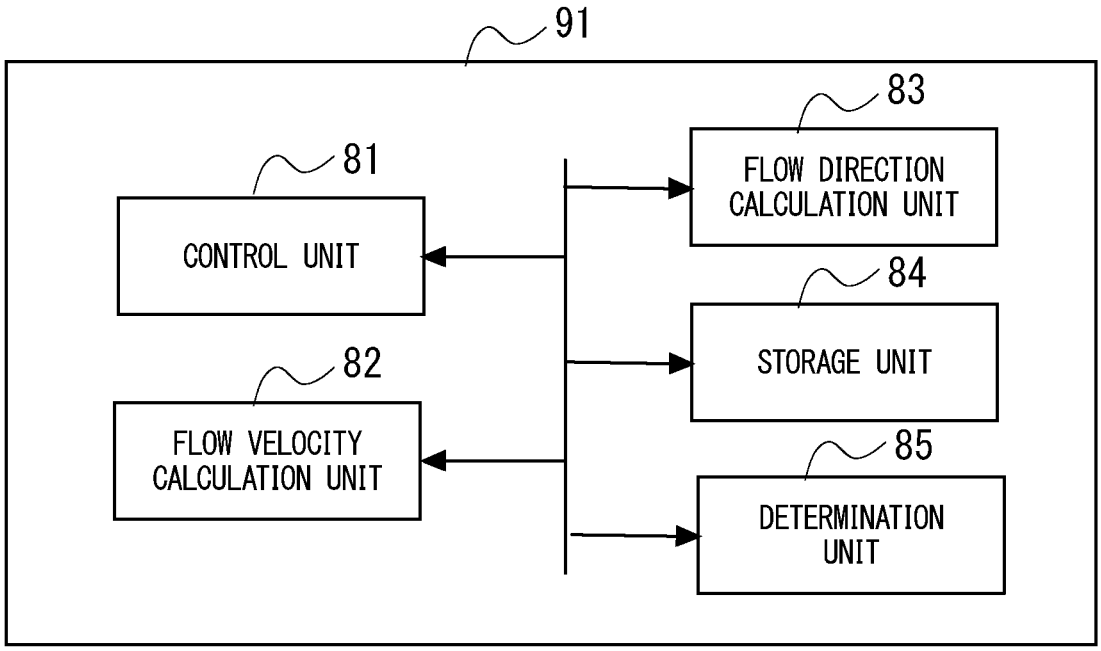
FIG. 5 is a functional block diagram of the control device according to the first embodiment of the present invention.

As shown in FIG. 5, the CPU 91 of the control device 90 has a control unit 81, a flow velocity calculation unit 82, a flow direction calculation unit 83, a storage unit 84, and a determination unit 85 by executing a program stored in advance in the control device 90 itself. The control unit 81 controls other functional units provided in the control device 90. Values of the temperature differences described above detected by the detection devices 21 are input to the flow velocity calculation unit 82 and the flow direction calculation unit 83 as numerical value information.

The flow velocity calculation unit 82 calculates a flow velocity of air on the basis of an absolute value of the temperature difference. The flow direction calculation unit 83 calculates a flow direction of air on the basis of the positive and negative of the temperature difference. The determination unit 85 compares the flow velocity calculated by the flow velocity calculation unit 82 and the flow direction calculated by the flow direction calculation unit 83 with threshold values stored in the storage unit 84. For example, when a decrease in flow velocity or a reversal of a flow direction is detected only by the second detection device 21B disposed in the downstream region 11B (that is, a temperature difference changes so that the temperature difference decreases), an electric signal used for adjusting the opening degree of the inlet guide vane 11C so that the opening degree increases is transmitted to the inlet guide vane 11C. On the other hand, when a decrease in flow velocity or a reversal of a flow direction is detected only by the first detection device 21A disposed in the upstream region 11A (that is, a temperature difference changes so that the temperature difference decreases), the determination unit 85 transmits an electric signal used for adjusting the opening degree of the blow-off valve V so that the opening degree increases to the blow-off valve V.

An operation of the gas turbine 100 according to the embodiment will be described below. When the gas turbine 100 is operated, first, the compressor 11 is driven using an electric motor or the like (not shown). When the compressor 11 is driven, external air is taken into the compressor 11 via the inlet guide vane 11C and high-pressure air is generated. The combustor 2 mixes fuel with this high-pressure air and burns the mixture to generate high-temperature and high-pressure combustion gas. The turbine 3 is rotationally driven using the combustion gas. A rotational force of the turbine 3 is taken out from a shaft end and used for driving an electric generator (not shown) or the like.

Here, it is known that, when an operation point is changed so that a pressure ratio is increased while the number of revolutions is kept constant in the compressor 11 as described above, a phenomenon called turning stall or surging occurs. Particularly, surging is likely to lead to backflow of a working fluid inside the compressor or vibration of the rotor shaft in some cases. Thus, in the embodiment, the detection device 21 described above detects a flow velocity and a flow direction as physical quantities of air and the control device 90 adjusts either the opening degree of the inlet guide vane 11C and the opening degree of the blow-off valve V on the basis of the flow velocity and the flow direction.

To be specific, it can be determined that, when the temperature difference between the pair of temperature detection units 61 detected by the second detection device 21B for the downstream region 11B decreases, the flow velocity of the working fluid has decreased in the downstream region 11B. When the flow velocity continues to decrease, this is likely to eventually lead to a change in the flow direction in some cases. That is to say, it can be said that a decrease in flow velocity is an indication of backflow. In this case, it can be determined that a flow rate of the working fluid in the downstream region 11B of the compressor 11 becomes excessive and a flow of the working fluid begins to come to a standstill (surging is occurring). Thus, the control device 90 adjusts the opening degree of the inlet guide vane 11C so that the opening degree increases.

On the other hand, it can be determined that, when the temperature difference between the pair of temperature detection units 61 detected by the first detection device 21A for the upstream region 11A decreases, a flow velocity of the working fluid has decreased in the upstream region 11A. In this case, it can be determined that a flow rate of the working fluid in the upstream region 11A of the compressor 11 becomes excessive and a flow of the working fluid begins to come to a standstill (surging is occurring in some cases). Thus, the control device 90 adjusts the opening degree of the blow-off valve V so that the opening degree increases and adjusts an amount of air extracted through the blow-off flow path L so that the extraction amount increases. Thus, for example, when backflow (that is, a change in the flow direction) occurs in the flow of the working fluid inside the compressor or a decrease in the flow velocity that is an indication of backflow occurs, it is possible to immediately detect the backflow and the decrease in the flow velocity.

As described above, according to the constitution associated with the embodiment, at least one of the detection devices 21 is provided for the upstream region 11A and the downstream region 11B of the compressor 11. The detection device 21 detects a physical quantity of the working fluid. The control device 90 detects an abnormality occurring in a flow of the working fluid on the basis of the changes in the physical quantity. The control device 90 adjusts either the opening degree of the inlet guide vane 11C or the extraction amount. Thus, it is possible to eliminate the abnormality occurring in the flow of the working fluid.

Also, according to the above constitution, the detection device 21 has the pair of temperature detection units 61 arranged in the flow direction Df and the heating unit 62 provided between them. When the working fluid passes through the pair of temperature detection units 61 in the flow direction Df, the working fluid is heated by the heating unit 62. Therefore, a difference occurs in a temperature which is detected between the temperature detection unit 61 located on the downstream side in the flow direction Df and the temperature detection unit 61 located the upstream side in the flow direction Df. Therefore, it is possible to detect that the working fluid is flowing toward a side on which the temperature detection unit 61 having a higher detected temperature is located. That is to say, it is possible to detect the flow direction Df of the working fluid. Furthermore, when an absolute value of the temperature difference detected using the pair of temperature detection units 61 is detected, it is also possible to detect changes in the flow velocity of the working fluid. Thus, for example, when backflow (that is, a change in the flow direction) occurs in the flow of the working fluid inside the compressor 11 or a decrease in the flow velocity that is an indication of backflow occurs, these can be detected immediately.

In addition, according to the above constitution, it can be determined that, when the temperature difference between the pair of temperature detection units 61 detected by the detection device 21 of the downstream region 11B decreases, the flow velocity of the working fluid has decreased in the downstream region 11B. When the flow velocity continues to decrease, this is likely to eventually lead to a change in the flow direction. That is to say, it can be said that the decrease in flow velocity is an indication of backflow. In this case, it can be determined that the flow rate of the working fluid in the downstream region 11B of the compressor 11 becomes excessive and the flow of the working fluid begins to come to a standstill (surging is occurring). Thus, the control device 90 adjusts the opening degree of the inlet guide vane 11C so that the opening degree increases. Therefore, the flow rate of the working fluid supplied to the downstream region 11B increases. As a result, surging can be prevented before the development thereof.

Furthermore, according to the above constitution, it can be determined that, when the temperature difference between the pair of temperature detection units 61 detected by the detection device 21 of the upstream region 11A decreases and the flow velocity of the working fluid has decreased in the upstream region 11A. When the flow velocity continues to decrease, this is likely to eventually lead to a change in the flow direction. That is to say, it can be said that the decrease in flow velocity is an indication of backflow. In this case, it can be determined that the flow rate of the working fluid in the upstream region 11A of the compressor 11 becomes excessive and the flow of the working fluid begins to come to a standstill (surging is occurring). Thus, the control device 90 performs adjustment so that an amount of extraction through the blow-off flow path L increases. Therefore, the working fluid coming to a standstill in the upstream region 11A is extracted and the standstill in the flow is eliminated. As a result, surging can be prevented before the development thereof.

Here, it is known that, in the compressor 11 as described above, surging particularly easily occurs in a region further upstream than a rotor blade stage 42 that is a third stage from the furthest upstream side and a region further downstream than a rotor blade stage 42 that is a third stage from the furthest downstream side. According to the above constitution, since these regions are the upstream region 11A and the downstream region 11B, it is possible to detect the occurrence of surging and the indication promptly and accurately.

The first embodiment of the present invention has been described above. Various changes and modifications can be provided to the above constitution without departing from the gist of the present invention. For example, in the above embodiment, the constitution in which the detection device 21 is provided on the inner circumferential surface of the casing 30 in the upstream region 11A and the downstream region 11B has been described.

Figure 7:
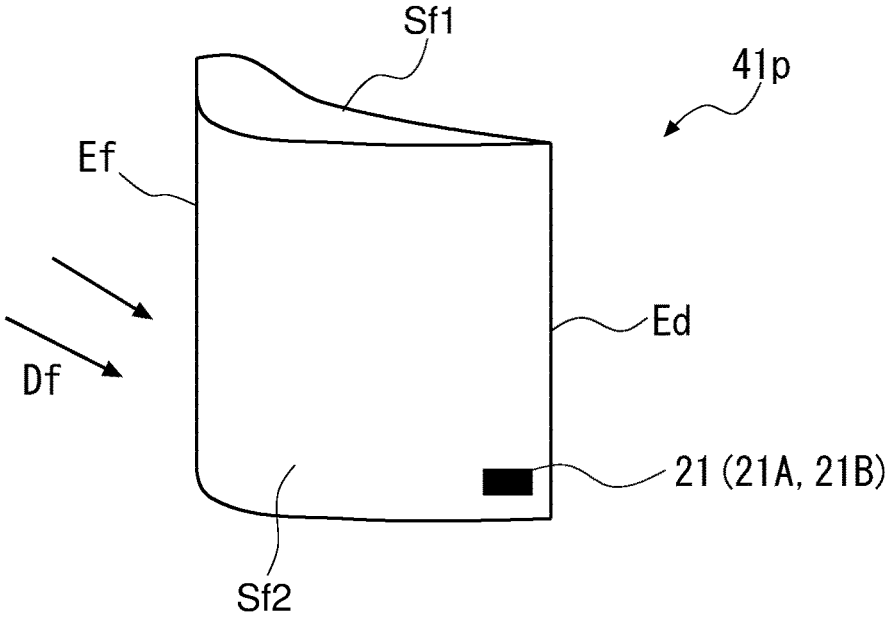
FIG. 7 is a perspective view showing a constitution of a stator blade according to a modified example of the first embodiment of the present invention.

However, as another example, as shown in FIG. 7, it is also possible to provide a detection device 21 on a stator blade 41*p* in a stator blade stage 41. To be more specific, the stator blade stage 41 has a plurality of stator blades 41*p* arranged in a circumferential direction along an inner circumferential surface of a casing 30. It is possible to provide the detection device 21 on at least one of the stator blades 41*p*. Each of the stator blades 41*p* has an airfoil-shaped cross section in which the stator blade extends from an upstream side toward a downstream side in a flow direction Df A surface facing downstream in the flow direction Df is concave toward the downstream side to serve as a pressure surface Sf1. A surface facing downstream is convex toward the upstream side to serve as a suction surface Sf2. Furthermore, an upstream edge is a leading edge Ef and a downstream edge is a trailing edge Ed. It is preferable that the detection device 21 be provided at a position biased outward or inward in a radial direction on the suction surface Sf2 and closer to the trailing edge Ed than the leading edge Ef.

Here, separation or backflow of the working fluid particularly easily occurs on the suction surface Sf2 of the stator blade 41*p*. According to the above constitution, since the detection device 21 is provided on the suction surface Sf2, it is possible to promptly and accurately detect the separation and the backflow described above.

Second Embodiment

Figure 8:
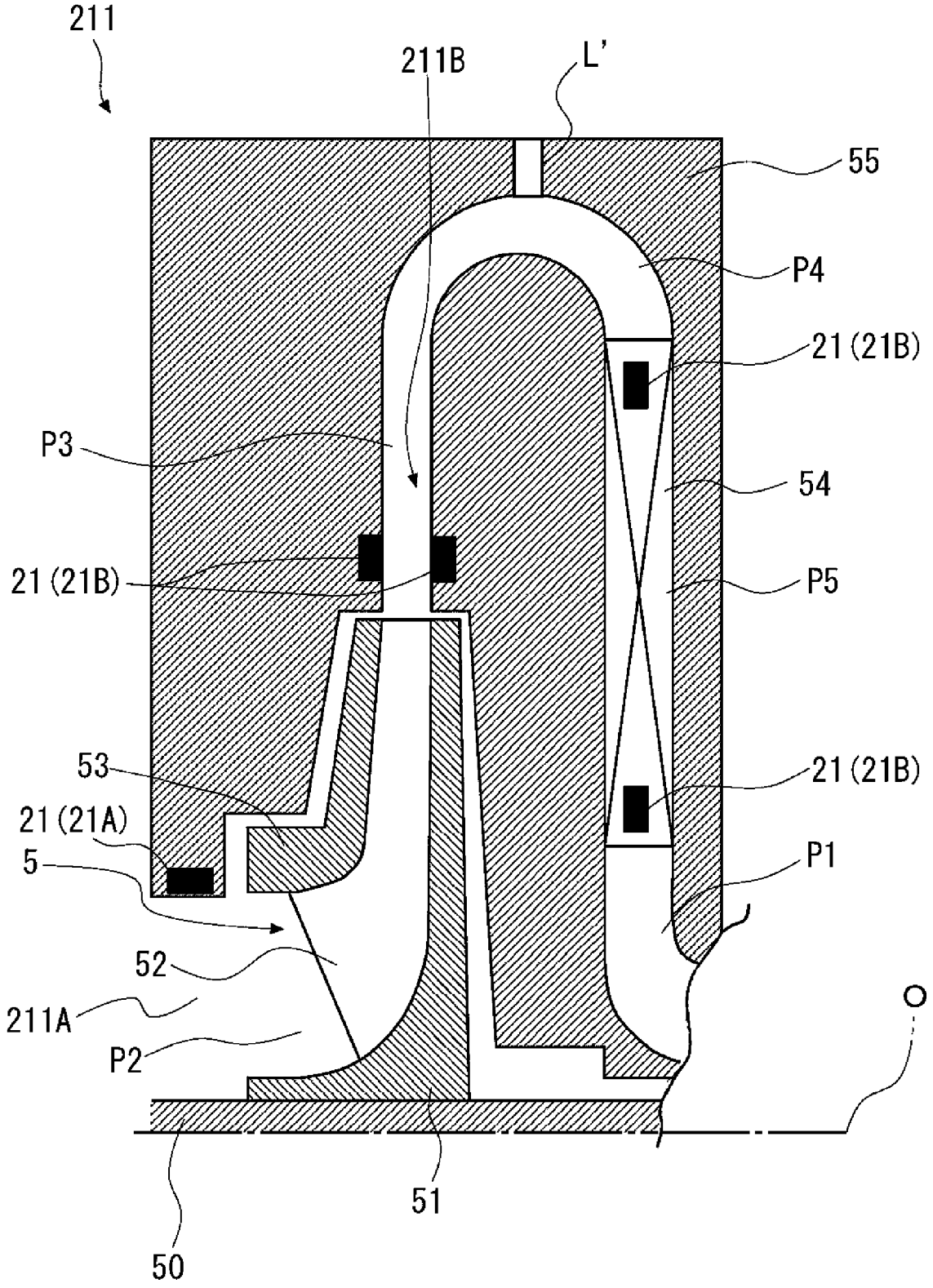
FIG. 8 is a cross-sectional view showing a constitution of a compressor system according to a second embodiment of the present invention.

A second embodiment of the present invention will be described below with reference to FIG. 8. Constituent elements in the second embodiment that are the same as those of the first embodiment described above will be denoted by the same reference numerals and detailed description thereof will be omitted. As shown in FIG. 8, in the embodiment, the detection devices 21 described above are provided in a compressor 211 as a centrifugal compressor.

The compressor 211 has a rotor shaft 50 which can rotate around an axis line O, an impeller 5 that is integrally fixed to the rotor shaft 50, and a casing 55 which covers the impeller 5 from an outer circumferential side. The impeller 5 has a disk 51 extending in the radial direction of the axis line O, a plurality of blades 52 provided on a surface of the disk 51 facing upstream, and a cover 53 which covers the blades 52 from the upstream side. An impeller flow path P2 through which air as a working fluid flows is formed between the cover 53, the disk 51, and the blades 52 adjacent to each other.

A guide flow path P1, a diffuser flow path P3, a return bend section P4, and a return flow path P5 communicating with the impeller flow path P2 are provided inside the casing 55. The diffuser flow path P3 communicates with a radially outer end portion of the impeller flow path P2 and extends outward in the radial direction. The return bend section P4 communicates with the radially outer end portion of the diffuser flow path P3 and extends in a direction in which the return bend section P4 is reversed to be directed inward in the radial direction. The blow-off flow path L' described in the first embodiment described above is connected to the most radially outer side of the return bend section P4. The return flow path P5 communicates with a downstream side of the return bend section P4 and communicates with the guide flow path P1 of a subsequent stage located on the downstream side. A return vane 54 is provided in the return flow path P5.

In such a compressor 211, a region further upstream than the impeller 5 is an upstream region 211A and a region further downstream than the impeller 5 is a downstream region 211B. One (the first detection device 21A) of the detection devices 21 described in the first embodiment described above is provided in the upstream region 211A. To be specific, the first detection device 21A is provided on an inner circumferential surface of the casing 55 in the guide flow path P1. Second detection devices 21B are provided in the downstream region 211B. To be specific, each of the second detection devices 21B are provided on each upstream side wall surface and each downstream side wall surface of the diffuser flow path P3. In addition, each of the second detection devices 21B is provided on an upstream end portion and a downstream end portion of the return vane 54. It is also possible to adopt a constitution in which the second detection device 21B is provided in only one of the diffuser flow path P3 and the return vane 54.

Here, it is known that, in the compressor 211 as described above, surging particularly easily occurs in a region further upstream than the impeller 5 and a region further downstream than the impeller 5. According to the above constitution, since the regions are the upstream region 211A and the downstream region 211B and the detection device 21 is provided each of the regions, it is possible to promptly and accurately detect the occurrence of surging and an indication thereof.

Also, according to the above constitution, since the detection device 21 is provided in at least one of the diffuser flow path P3 and the return flow path P5, it is possible to finely and accurately detect the occurrence of surging and an indication thereof in the downstream region 211B.

The second embodiment of the present invention has been described above. Various changes and modifications can be provided to the above constitution without departing from the gist of the present invention.

Third Embodiment

A compressor system 200 according to a third embodiment of the present invention will be described below with reference to FIGS. 9 to 11. Constituent elements in the third embodiment that are the same as those of each of the above embodiments will be denoted by the same reference numerals and detailed description thereof will be omitted. In the embodiment, the control of an inlet guide vane 11C when a command for reducing a load of a gas turbine 100 is issued will be described.

Figure 9:
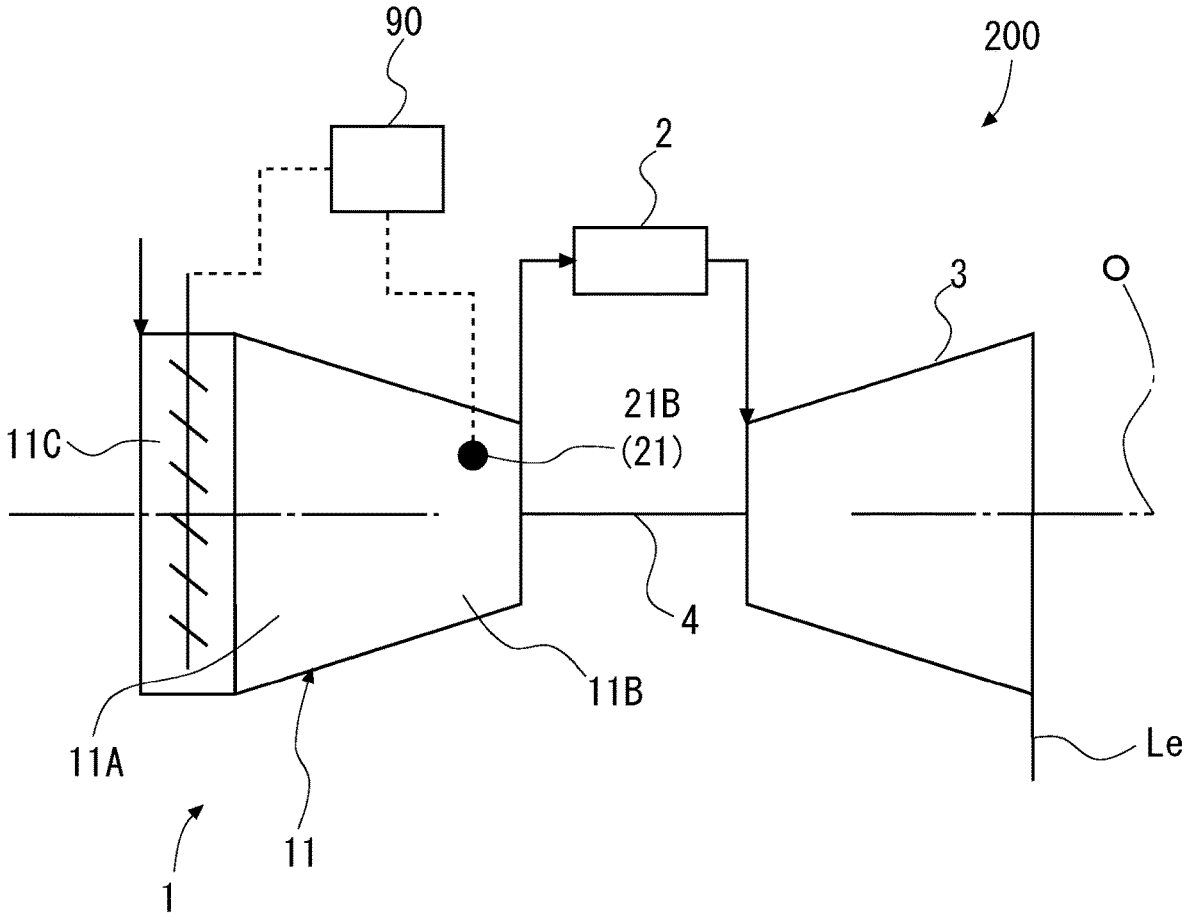
FIG. 9 is a diagram showing a constitution of a gas turbine according to a third embodiment of the present invention.

As shown in FIG. 9, in the compressor system 200 according to the embodiment, a detection device 21 has only the second detection device 21B described above. Furthermore, the compressor system 200 does not have the blow-off flow path L (the extraction part) and the blow-off valve V described above. In addition, a constitution of a control device 90 is different from that of each of the embodiments described above.

Figure 10:
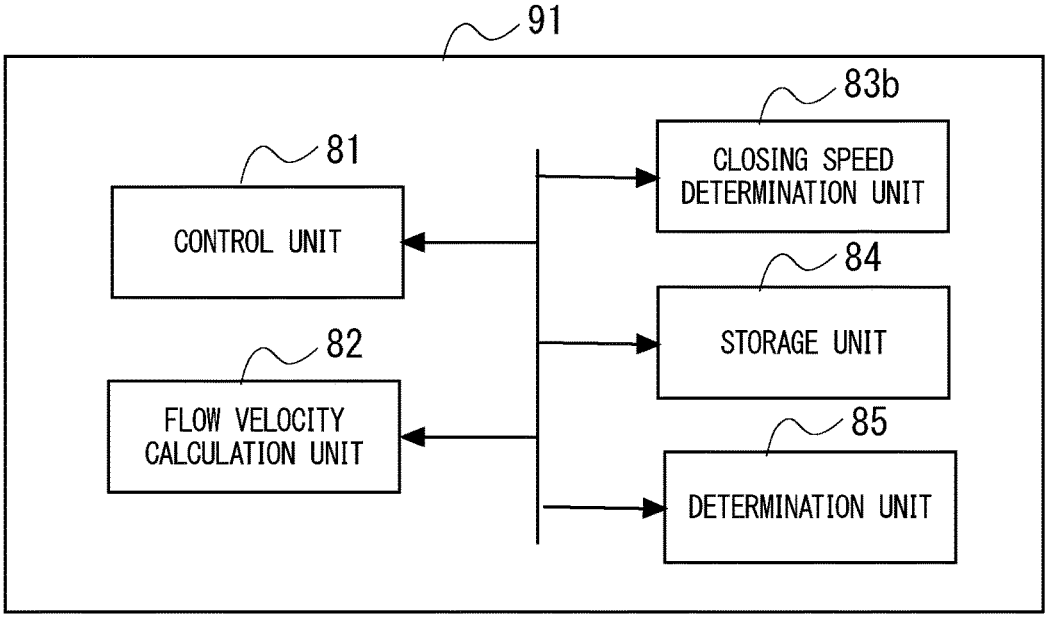
FIG. 10 is a functional block diagram of a control device according to the third embodiment of the present invention.
Figure 11:
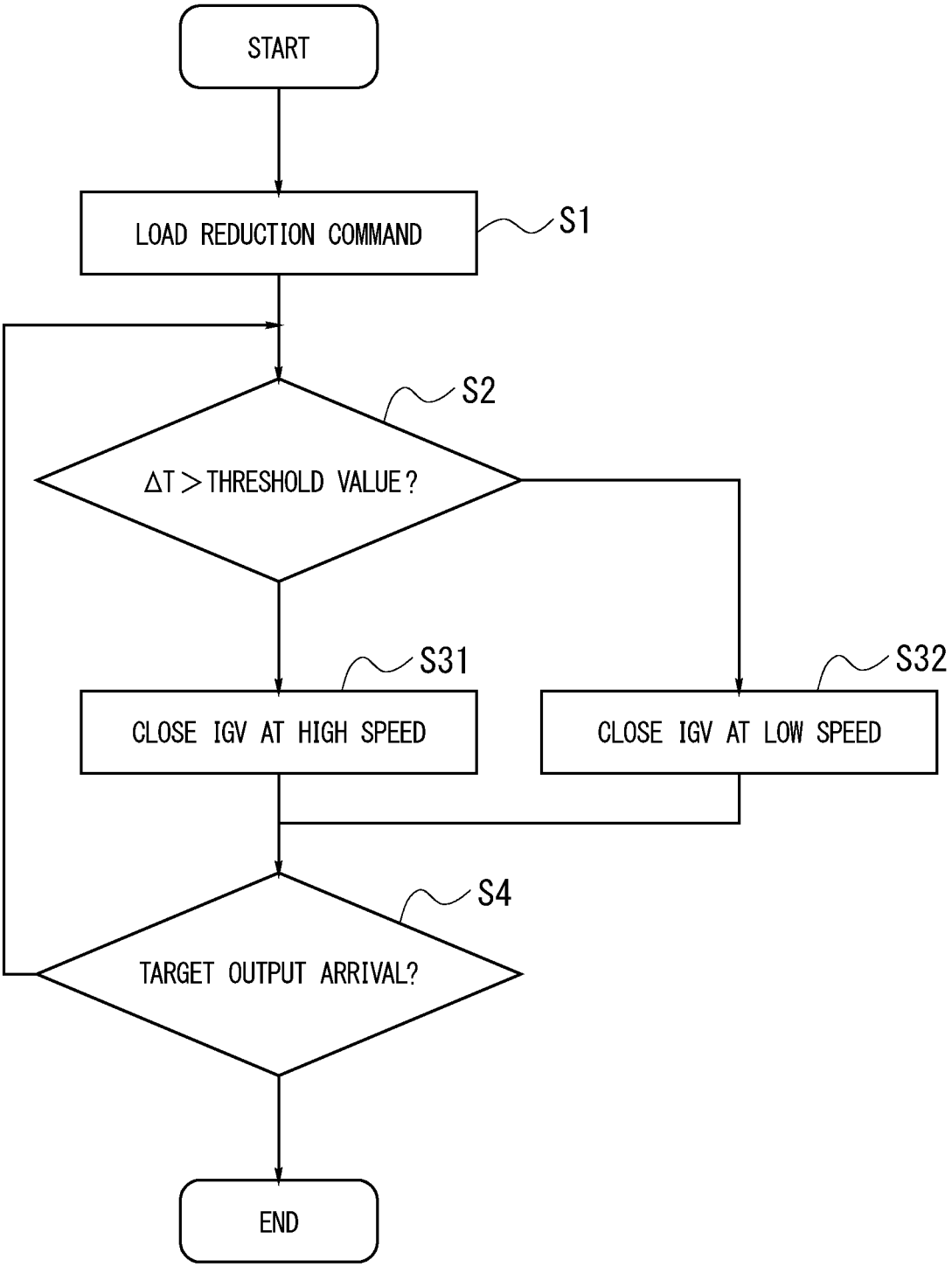
FIG. 11 is a flowchart for describing an operation of the control device according to the third embodiment of the present invention.

As shown in FIG. 10, the control device 90 includes a control unit 81, a flow velocity calculation unit 82, a closing speed determination unit 83*b*, a storage unit 84, and a determination unit 85. The control unit 81 controls other functional units provided in the control device 90. The above value concerning the temperature difference detected by the detection device 21 is input to the flow velocity calculation unit 82 as numerical value information.

The flow velocity calculation unit 82 calculates a flow velocity (or a flow rate) of air on the basis of an absolute value of the temperature difference. The determination unit 85 compares a flow velocity calculated by the flow velocity calculation unit 82 with a threshold value stored in the storage unit 84. The closing speed determination unit 83*b* determines a closing speed of the inlet guide vane 11C on the basis of the determination result of the determination unit 85. To be more specific, as shown in FIG. 11, after a load reduction command (Step S1) is issued, magnitudes between a value concerning the above temperature difference (that is, the flow velocity) and a predetermined threshold value are compared (Step S2). When it is determined that the temperature difference is greater than the threshold value, the inlet guide vane 11C is closed at a relative high speed (Step S31). On the other hand, when it is determined that the temperature difference is smaller than the threshold value, the inlet guide vane 11C is closed at a relatively low speed. After that, a determination concerning whether an output of the gas turbine 100 has decreased to a target output is performed (Step S4). When it is determined that the output of the gas turbine 100 has not decreased to the target output, Step S2 to Step S4 described above are repeatedly performed again. When it is determined that the output of the gas turbine 100 has dropped to the target output, the process is completed.

Here, when a command for reducing a load of the compressor 11 (the gas turbine 100) is issued, if the inlet guide vane 11C is closed at an excessively high speed to reduce an amount of air to flow in, there is a risk of there being an amount of air compressed in the downstream region 11B being insufficient and air flowing back to the upstream side (a surge may occur). On the other hand, when the inlet guide vane 11C is closed at an excessively low speed, a temperature of combustion gas decreases due to an excessive amount of air supplied to a combustor 2 provided on the downstream side. As a result, there is a risk of generating combustion vibration and increasing an amount of NOx to be discharged. According to the above constitution, the control device 90 determines a speed at which the inlet guide vane 11C is closed on the basis of the temperature difference detected by means of a pair of temperature detection units 61, that is, a velocity or a flow rate of a fluid. For this reason, it is possible to close the inlet guide vane 11C at an appropriate speed while preventing the surge and the unstable combustion described above. As a result, it is possible to stably and quickly reduce a load of the gas turbine 100.

Also, according to the above constitution, it is possible to determine an optimum speed at which the inlet guide vane 11C is closed simply by evaluating the flow velocity or the flow rate 9 on the basis of the predetermined threshold value. Thus, it is possible to quickly reduce a load of the gas turbine 100 while reducing the likelihood of surges and unstable combustion occurring.

The third embodiment of the present invention has been described above. Various changes and modifications can be provided to the above constitution without departing from the gist of the present invention. For example, the control device 90 described in the third embodiment (that is, the control device 90 further including the closing speed determination unit 83*b*) can also be combined with and applied to the constitution described in the first embodiment (that is, the constitution in which the first detection device 21A, the blow-off flow path L, and the blow-off valve V are included).

Also, an operation of the closing speed determination unit 83*b* in the third embodiment is an example. In addition, as another example, it is also possible to constitute a closing speed determination unit 83*b* so that the process shown in FIGS. 12 and 13 is performed.

Figure 12:
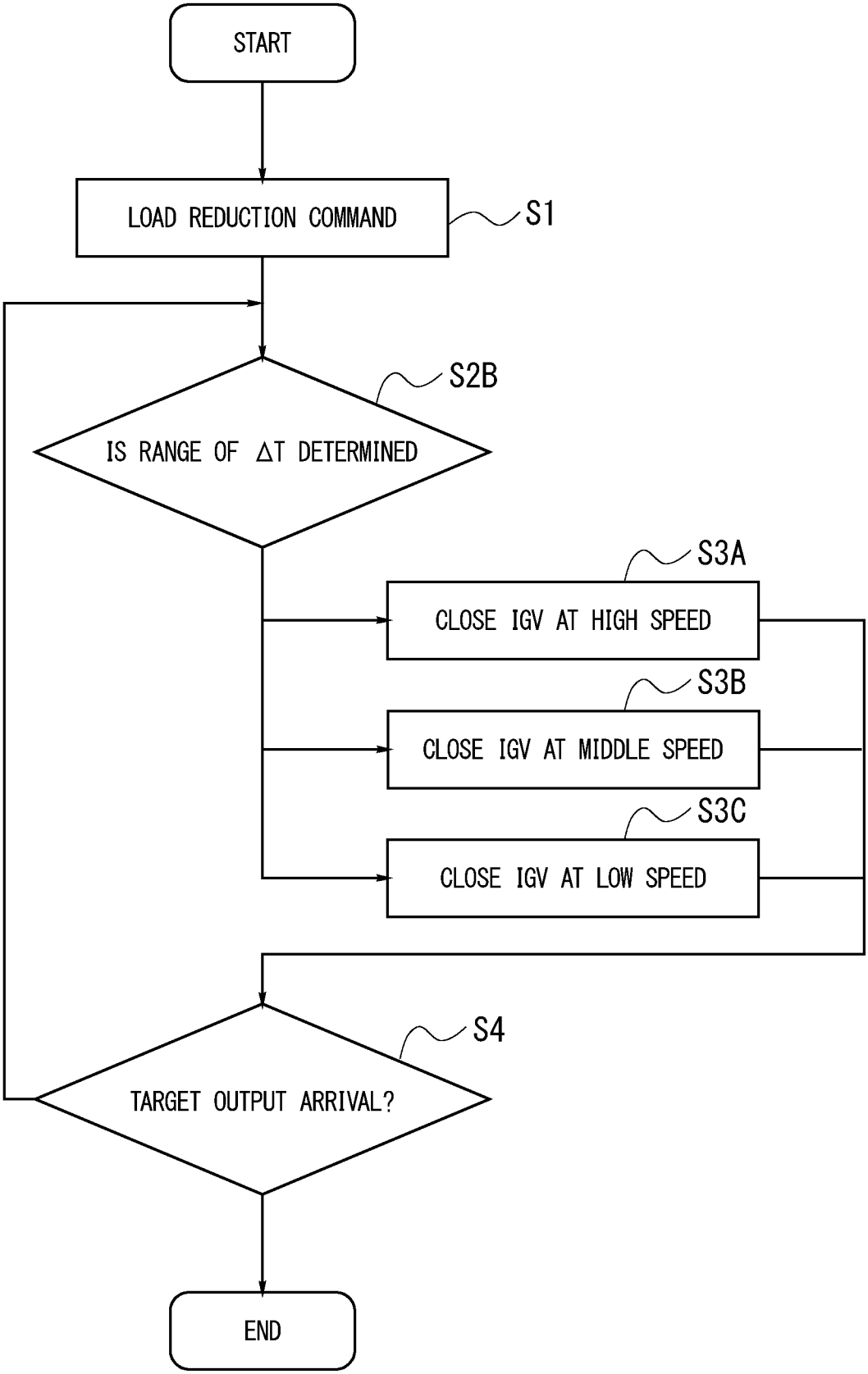
FIG. 12 is a flowchart for describing a modified example of an operation of the control device according to the third embodiment of the present invention.

In the example of FIG. 12, the control device 90 determines a detailed numerical range of a temperature difference (that is, a flow velocity or a flow rate) detected by means of a temperature detection device 21 included in a plurality of predetermined continuous numerical ranges (Step 2B). In addition, the inlet guide vane 11C is closed by selecting a predetermined closing speed to correspond to the numerical range to which the temperature difference belongs (Steps S3A to S3C). Although three speeds (a high speed, a medium speed, and a low speed) are set as speeds for closing the inlet guide vane 11C in the example of FIG. 12, the number of speed ranges is not limited to three and four or more speed ranges can be set.

According to the above constitution, it is possible to close the inlet guide vane 11C by selecting a speed determined to correspond to the numerical range to which the detection result of the temperature detection device 21 belongs. That is to say, it is possible to finely determine a speed for closing the inlet guide vane 11C on the basis of the magnitude of the temperature difference (that is, the flow velocity or the flow rate). As a result, it is possible to more quickly reduce a load of the gas turbine 100 while further reducing the likelihood of surges and unstable combustion occurring.

Figure 13:
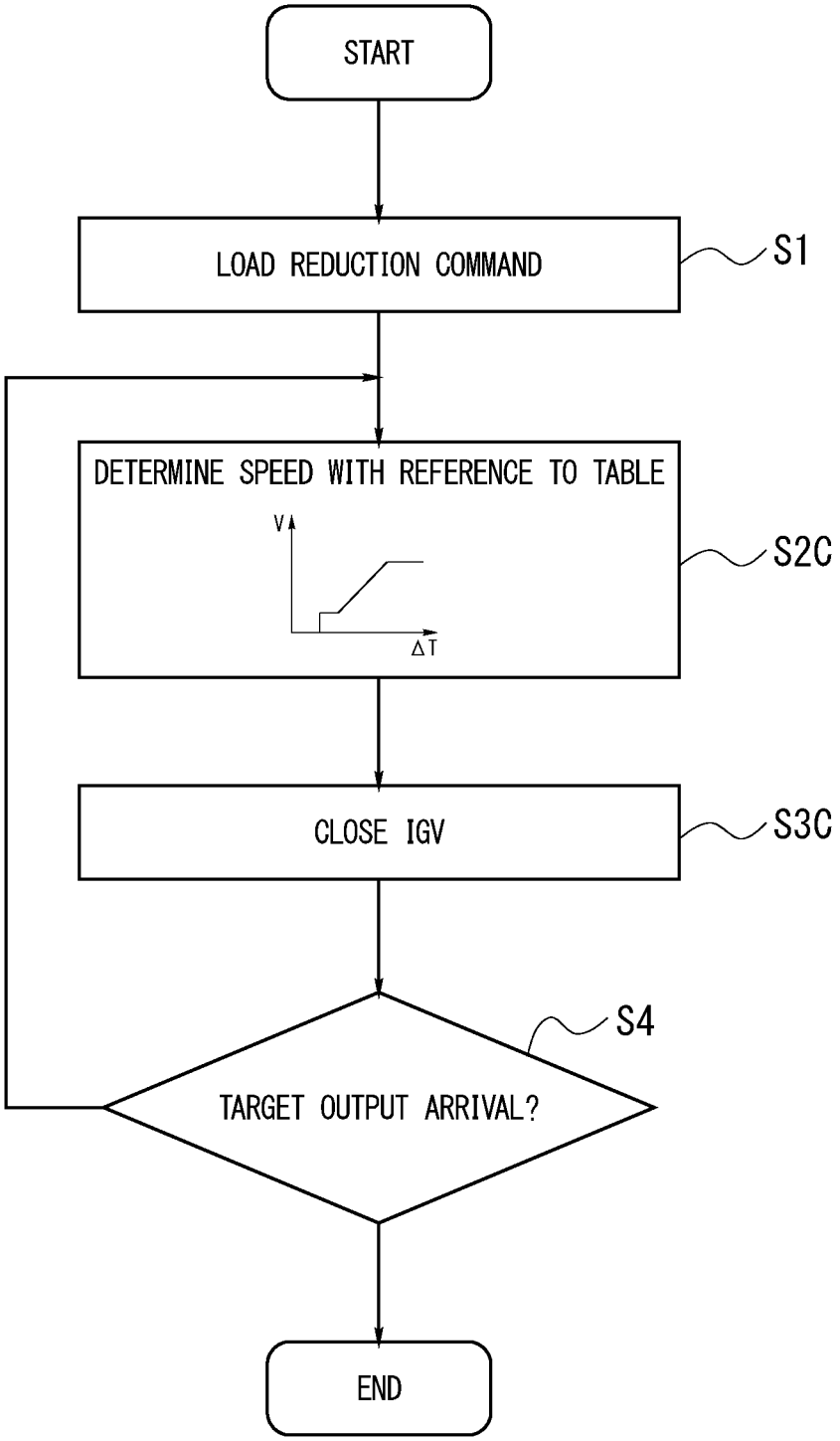
FIG. 13 is a flowchart for describing another modified example of the operation of the control device according to the third embodiment of the present invention.

In the example of FIG. 13, the control device 90 determines a speed at which the inlet guide vane 11C is closed with reference to a table in which a relationship between the detection result of the temperature detection unit 21 and the optimum speed at which the inlet guide vane 11C is closed according to the value concerning the temperature difference is shown (Step S2C). After that, the inlet guide vane 11C is closed at the determined speed (Step S3C).

According to the above constitution, it is possible to close the inlet guide vane 11C by selecting the speed in accordance with the table in which the relationship between the optimum speed at which the inlet guide vane 11C is closed and the temperature difference (that is, the flow velocity or the flow rate) is shown. That is to say, it is possible to more finely determine the speed at which the inlet guide vane 11C is closed on the basis of the magnitude of the temperature difference. Thus, it is possible to more quickly reduce a load of the gas turbine 100 while further reducing the likelihood of surges and unstable combustion occurring.

INDUSTRIAL APPLICABILITY

According to the present invention, it is possible to provide a compressor system capable of detecting the occurrence of surging with higher accuracy and minimizing surging.

REFERENCE SIGNS LIST

100, 200 Gas turbine
1 Compressor system
2 Combustor
3 Turbine
4, 50 Rotor shaft
5 Impeller
11, 211 Compressor
11A, 211A Upstream region
11B, 211B Downstream region
11C Inlet guide vane
21 Detection device
21A First detection device
21B Second detection device
30, 55 Casing
41 Stator blade stage
41A First stator blade stage
41B Second stator blade stage
41C Outlet stator blade stage
41D Outlet final stator blade stage
41E Diffuser flow path stator blade stage
42A First rotor blade stage
42B Second rotor blade stage
42C Outlet rotor blade stage
42D Outlet final rotor blade stage
51 Disk
52 Blade
53 Cover
54 Return vane
61 Temperature detection unit
62 Heating unit
81 Control unit
82 Flow velocity calculation unit
83 Flow direction calculation unit
83*b* Closing speed determination unit
84 Storage unit
85 Determination unit
90 Control device
91 CPU
92 ROM
93 RANI
94 HDD
95 I/O
Df Flow direction
Ed Trailing edge
Ef Leading edge
L, L' Blow-off flow path
Le Exhaust flow path
O Axis line
P1 Guide flow path
P2 Impeller flow path
P3 Diffuser flow path
P4 Return bend section
P5 Return flow path
Sf1 Pressure surface
Sf2 Pressure surface
S1 Pressure surface
S2 Suction surface
Td, Tu Temperature
V Blow-off valve

The invention claimed is:

1. A compressor system, comprising:

a compressor having:

an upstream region into which a working fluid flows, a downstream region that communicates with the upstream region and in which a pressure of the working fluid is greater than that in the upstream region, inlet guide vanes that are provided further upstream than the upstream region and are capable of altering a flow rate of the working fluid flowing into the upstream region, and an extraction part that is provided to a portion between the upstream region and the downstream region and is capable of extracting at least a portion of the working fluid;

detection devices, at least one of which is provided in each of the upstream region and the downstream region, for detecting a physical quantity of the working fluid; and a control device for adjusting, on the basis of changes in the physical quantity detected by the detection devices, an opening degree of the inlet guide vanes and an amount extracted by the extraction part, wherein the physical quantity includes a flow direction and a flow velocity of the working fluid based on a temperature of the working fluid.

2. The compressor system according to claim 1, wherein each of the detection devices includes:

a pair of temperature detection units that are arranged in a flow direction of the working fluid; and a heating unit that is disposed between the pair of temperature detection units and heats the working fluid, wherein the physical quantity includes a temperature difference of the working fluid detected by the pair of temperature detection units.

3. The compressor system according to claim 2, wherein the temperature detection unit and the heating unit are directed exposed to the working fluid.

4. The compressor system according to claim 2, wherein the control device adjusts the opening degree of the inlet guide vanes so that the opening degree increases when the temperature difference changes so that the temperature difference decreases in the downstream region.

5. The compressor system according to claim 2, wherein the control device adjusts the extraction amount so that the extraction amount increases when the temperature difference changes in the upstream region so that the temperature difference decreases.

6. The compressor system according to claim 1, wherein the compressor includes:

a rotor shaft that is capable of rotating around an axis line;

a plurality of rotor blade stages that are provided on the rotor shaft and arranged in a direction of the axis line;

a casing that covers the rotor shaft and the rotor blade stages from an outer circumferential side; and a plurality of stator blade stages that are provided on an inner circumferential surface of the casing and arranged alternately with the plurality of rotor blade stages in the direction of the axis line, wherein the upstream region is a region further upstream than a rotor blade stage of the plurality of rotor blade stages that is a third stage from the furthest upstream side, and wherein the downstream region is a region further downstream than a rotor blade stage of the plurality of rotor blade stages that is a third stage from the furthest downstream side.

7. The compressor system according to claim 6, wherein each of the stator blade stages extends in a radial direction with respect to the axis line and includes a plurality of stator blades arranged in a circumferential direction and having a suction surface facing upstream and a pressure surface facing downstream, and the detection device is provided on the suction surface.

8. The compressor system according to claim 1, wherein the compressor includes:

a rotor shaft that is capable of rotating around an axis line;

an impeller that is provided on the rotor shaft; and a casing that covers the impeller from an outer circumferential side and forms a flow path through which the working fluid flows on an upstream side and a downstream side of the impeller, wherein the upstream region is a region in the flow path further upstream than the impeller, and wherein the downstream region is a region in the flow path further downstream than the impeller.

9. The compressor system according to claim 8, wherein the flow path has a diffuser flow path provided on a downstream side of the impeller and configured to guide the working fluid from an inner side to an outer side in the radial direction with respect to the axis line and a return flow path provided further downstream of the diffuser flow path and configured to guide the working fluid from the outer side to the inner side in the radial direction, and the detection device is provided in at least one of the diffuser flow path and the return flow path.

10. A compressor system, comprising:

a compressor having:

an upstream region into which a working fluid flows, a downstream region that communicates with the upstream region and in which a pressure of the working fluid is greater than that in the upstream region, inlet guide vanes that are provided further upstream than the upstream region and are capable of altering a flow rate of the working fluid flowing into the upstream region, and an extraction part that is provided to a portion between the upstream region and the downstream region and is capable of extracting at least a portion of the working fluid;

detection devices, at least one of which is provided in each of the upstream region and the downstream region, for detecting a physical quantity of the working fluid; and a control device for adjusting, on the basis of changes in the physical quantity detected by the detection devices, an opening degree of the inlet guide vanes and an amount extracted by the extraction part, wherein the compressor includes:

a rotor shaft that is capable of rotating around an axis line;

a plurality of rotor blade stages that are provided on the rotor shaft and arranged in a direction of the axis line;

a casing that covers the rotor shaft and the rotor blade stages from an outer circumferential side; and a plurality of stator blade stages that are provided on an inner circumferential surface of the casing and arranged alternately with the plurality of rotor blade stages in the direction of the axis line, wherein the upstream region is a region further upstream than a rotor blade stage of the plurality of rotor blade stages that is a third stage from the furthest upstream side, wherein the downstream region is a region further downstream than a rotor blade stage of the plurality of rotor blade stages that is a third stage from the furthest downstream side, wherein each of the stator blade stages extends in a radial direction with respect to the axis line and includes a plurality of stator blades arranged in a circumferential direction and having a suction surface facing upstream and a pressure surface facing downstream, wherein each of the detection devices is provided on the suction surface, and wherein the physical quantity includes a flow direction and a flow velocity of the working fluid based on a temperature of the working fluid.

11. The compressor system according to claim 1, wherein the detection device includes:

a pair of temperature detection units that are arranged in a flow direction of the working fluid; and a heating unit that is disposed between the pair of temperature detection units and heats the working fluid, wherein the physical quantity includes a temperature difference of the working fluid detected by the pair of temperature detection units, and wherein the control device determines a speed at which each of the inlet guide vanes is closed on the basis of a magnitude of the physical quantity when a command for reducing a load of the compressor is issued.

12. The compressor system according to claim 11, wherein the control device closes the inlet guide vane at a relatively high speed when the physical quantity is greater than a predetermined threshold value and closes the inlet guide vane at a relatively low speed when the physical quantity is smaller than the threshold value.

13. The compressor system according to claim 11, wherein the control device determines to which numerical range of a plurality of predetermined numerical ranges the physical quantity belongs and closes the inlet guide vane by selecting a predetermined speed to correspond to the numerical range to which the physical quantity belongs.

14. The compressor system according to claim 11, wherein the control device determines a speed at which the inlet guide vane is closed with reference to a table in which a relationship between the physical quantity and an optimum speed at which the inlet guide vane is closed according to a value concerning the physical quantity is shown.

15. A compressor system, comprising:

a compressor having:

an upstream region into which a working fluid flows, a downstream region that communicates with the upstream region and in which a pressure of the working fluid is greater than that in the upstream region, and inlet guide vanes that are provided further upstream than the upstream region and are capable of altering a flow rate of the working fluid flowing into the upstream region;

detection devices, at least one of which is provided in the downstream region, for detecting a physical quantity of the working fluid; and a control device for adjusting, on the basis of changes in the physical quantity detected by the detection devices, an opening degree of the inlet guide vanes, wherein each of the detection devices includes a pair of temperature detection units that are arranged in a flow direction of the working fluid; and wherein a heating unit that is disposed between the pair of temperature detection units and heats the working fluid, wherein the physical quantity includes a temperature difference of the working fluid detected by the pair of temperature detection units, and wherein when a command for reducing a load of the compressor is issued, the control device determines a speed at which each of the inlet guide vanes is closed on the basis of a magnitude of the physical quantity.

16. The compressor system according to claim 15, wherein the control device closes the inlet guide vane at a relatively high speed when the physical quantity is greater than a predetermined threshold value and closes the inlet guide vane at a relatively low speed when the physical quantity is smaller than the threshold value.

17. The compressor system according to claim 15, wherein the control device determines to which numerical range of a plurality of predetermined numerical ranges the physical quantity belongs and closes the inlet guide vane by selecting a predetermined speed to correspond to the numerical range to which the physical quantity belongs.

18. The compressor system according to claim 15, wherein the control device determines a speed at which the inlet guide vane is closed with reference to a table in which a relationship between the physical quantity and an optimum speed at which the inlet guide vane is closed according to a value concerning the physical quantity is shown.

* * * * *